US009238503B2

(12) United States Patent
Kubo et al.

(10) Patent No.: US 9,238,503 B2
(45) Date of Patent: Jan. 19, 2016

(54) TRANSMISSION OF OUTBOARD MOTOR

(71) Applicant: SUZUKI MOTOR CORPORATION, Hamamatsu-shi, Shizuoka (JP)

(72) Inventors: Yoshiki Kubo, Hamamatsu (JP); Keisuke Daikoku, Hamamatsu (JP); Keiji Imanaga, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 14/326,772

(22) Filed: Jul. 9, 2014

(65) Prior Publication Data

US 2015/0017847 A1 Jan. 15, 2015

(30) Foreign Application Priority Data

Jul. 10, 2013 (JP) ..... 2013-144656

(51) Int. Cl.
*B63H 20/14* (2006.01)
*B63H 20/00* (2006.01)
*B63H 20/32* (2006.01)

(52) U.S. Cl.
CPC ..... *B63H 20/002* (2013.01); *B63H 20/14* (2013.01); *B63H 2020/323* (2013.01)

(58) Field of Classification Search
CPC ..... B63H 20/002; B63H 20/14
USPC ..... 440/75
See application file for complete search history.

(56) References Cited

U.S. PATENT DOCUMENTS

| | | | | |
|---|---|---|---|---|
| 4,400,163 | A * | 8/1983 | Blanchard | B63H 21/28 440/75 |
| 4,802,871 | A * | 2/1989 | Watanabe | B63H 20/002 440/75 |
| 5,597,334 | A * | 1/1997 | Ogino | B63H 5/10 184/6.12 |
| 6,431,929 | B2 * | 8/2002 | Schafer | B63H 20/002 192/107 R |
| 6,988,917 | B2 * | 1/2006 | Ohtsuki | B63H 23/26 440/5 |
| 2014/0045393 | A1 * | 2/2014 | Kuriyagawa | B63H 20/20 440/75 |
| 2015/0017847 | A1 * | 1/2015 | Kubo | B63H 20/002 440/75 |

FOREIGN PATENT DOCUMENTS

| | | |
|---|---|---|
| JP | S60-145777 | 8/1985 |
| JP | H03-14273 | 2/1991 |
| JP | H04-27757 | 7/1992 |
| JP | H06-104475 | 12/1994 |
| JP | 2009-149202 | 7/2009 |

* cited by examiner

*Primary Examiner* — Lars A Olson
*Assistant Examiner* — Jovon Hayes
(74) *Attorney, Agent, or Firm* — Troutman Sanders LLP

(57) ABSTRACT

A transmission is structured to include a drive shaft, a counter shaft, a gear train bridged between each of a drive shaft input shaft and output shaft and the counter shaft, and a dog clutch mechanism selectively switching a high shift speed and a low shift speed in a transmission chamber. In a lower part of a lower bearing of the counter shaft in a bottom part of the transmission chamber, a lower reserve part of lubrication oil is provided, and a lubrication oil pump sending lubrication oil to respective parts of the transmission from the lower reserve part is provided.

5 Claims, 19 Drawing Sheets

SEC. I-I

SEC. II-II

SEC. III-III

TRANSMISSION OF OUTBOARD MOTOR

CROSS-REFERENCE TO RELATED APPLICATIONS

This application is based upon and claims the benefit of priority of the prior Japanese Patent Application No. 2013-144656, filed on Jul. 10, 2013, the entire contents of which are incorporated herein by reference.

BACKGROUND OF THE INVENTION

1. Field of the Invention

The present invention relates to a transmission in an outboard motor having a drive shaft which couples an engine in an upper part and a propeller in a lower part.

2. Description of the Related Art

Conventionally, among outboard motors in which an engine as a driving force source disposed in an upper part of an outboard motor body and a propelling device having a propeller disposed in a lower part are coupled to each other via a drive shaft, there are ones in which a transmission is provided in an appropriate middle position of the drive shaft. The transmission is shifted according to the traveling state of a boat having such an outboard motor, to an environment, or the like, so as to improve power performance, fuel consumption performance, and so on of the outboard motor.

Various types are devised as a specific structure for such transmissions. For example, in an outboard motor described in Patent Document 1, an automatic transmission made up of two planetary gears, three multiple wet clutches, and one one-way clutch is provided on a drive shaft coupling an engine and a propelling device (lower unit). According to this example, by setting the position of the transmission to a substantially middle portion in a vertical direction of the outboard motor, an outboard motor with a transmission can be realized compactly without affecting the profile of the entire outboard motor, thereby achieving both acceleration performance and fuel consumption performance.

Moreover, in one described in Patent Document 2, a two-speed transmission is constituted of parallel-axis spur gears which have high power transmission efficiency. Further, there are known one in which a switch point of the transmission is set by using a centrifugal clutch, one in which a transmission case and a water pump case are constituted integrally as in Patent Document 3, and the like.

Patent Document 1: Japanese Laid-open Patent Publication No. 2009-149202

Patent Document 2: Japanese Examined Patent Application Publication No. 03-14273

Patent Document 3: Japanese Examined Utility Model Application Publication No. 04-27757

Patent Document 4: Japanese Examined Patent Application Publication No. 06-104475

In one of Patent Document 1, the multiple wet clutches need a strong hydraulic device, which is expensive and for which energy needed for operating a hydraulic pump to maintain hydraulic pressure is large, becoming a cause of hindering fuel consumption performance. Further, although the multiple wet clutches couple smoothly, unlike the case of a four-wheeled vehicle, this function is not needed as much as in the case of a four-wheeled vehicle because changes in propeller speed of a propeller which only has small inertial moment are absorbed in the outboard motor. Accordingly, for the multiple wet clutches, a merit of alleviating shift shock is small with respect to high price, large weight, and large operating energy. Besides this, the planetary gears are expensive, and moreover, they are inferior to parallel-axis spur gears with respect to motive power transmission efficiency, and the like. From these points, it goes without saying that they are not suitable for outboard motors.

Further, a shift change mechanism in one of Patent Document 2 is a mechanical link mechanism, and is not able to suppress a shock transmitted to the link when it is shifted. Then, the position at an intermediate point is tolerated at a time of shift transition, and thus there is a problem of wear due to a relative speed difference. Moreover, it is set to a low speed side at a time of motive power direct coupling or to a high speed side at a time of via counter. Thus, while cruising which largely affects fuel consumption, it is motive power transmission via counter, and the fuel consumption worsens by the amount of gear transmission efficiency.

Moreover, in one of Patent Document 3, a counter shaft is disposed in a front side in a traveling direction, and a counter gear is housed in a gear case of forward tapered type, which is advantageous in terms of hydromechanics. Thus, a large-diameter gear cannot be disposed, causing a strength-related problem. Further, gear shift is performed by the mechanical link mechanism, and hence there is a problem that a shock at a time of speed shift is transmitted as is to the link side, and the like.

On the other hand, the transmission as described above has a large number of moving parts, and lubrication of them is quite important for securing smooth operation. For example, in one of Patent Document 4, part of the transmission is immersed in lubrication oil pressure of an oil pan of lubrication oil for engine, to thereby lubricate main parts of the transmission. In this manner, special contrivances are made for lubricating the transmission, or special devices for lubrication have been required.

SUMMARY OF THE INVENTION

In view of such situations, it is an object of the present invention to provide a transmission of an outboard motor which improves power performance, fuel consumption performance, and the like, while smoothly and appropriately performing shift control.

A transmission of an outboard motor of the present invention is a transmission of an outboard motor in which a crank shaft extending in a vertical direction of an engine mounted on an upper side is coupled to a drive shaft, a gear type transmission capable of switching between at least two high and low speed ratios is interposed between a drive shaft input shaft coupled to the crank shaft and a drive shaft output shaft driving a propeller, which are separated into an upper part and a lower part of the drive shaft, wherein: the transmission is housed in a transmission chamber formed in a drive shaft housing and includes the drive shaft, a counter shaft disposed in parallel with the drive shaft, a gear train bridged between each of the drive shaft input shaft and output shaft and the counter shaft, and a dog clutch mechanism selectively switching a high shift speed and a low shift speed; and the transmission includes, in a lower part of a lower bearing of the counter shaft in a bottom part of the transmission chamber, a lower reserve part of lubrication oil reserving lubrication oil flowed down via this lower bearing, and a lubrication oil pump sending lubrication oil to respective parts of the transmission from this lower reserve part of lubrication oil.

Further, in the transmission of the outboard motor according to the present invention, the lubrication oil pump is constituted of a spiral pump formed by making a spiral trench in a hollow inside of the counter shaft.

Further, in the transmission of the outboard motor according to the present invention, the spiral trench of the spiral pump is formed as a spiral passage with the hollow inside of the counter shaft by inserting a separate cylinder penetrating vertically in the hollow inside of the counter shaft, and forming a spiral recessed trench in an outer periphery of this cylinder.

Further, in the transmission of the outboard motor according to the present invention, an upper reserve part of lubrication oil is provided in an upper part of the counter shaft, the lubrication oil pump pumps up lubrication oil to the upper reserve part of lubrication oil via the hollow inside of the counter shaft, and a lubrication oil passage is provided which supplies lubrication oil to an upper bearing of the counter shaft and a bearing of the drive shaft input shaft from this upper reserve part of lubrication oil.

DETAILED DESCRIPTION OF THE PREFERRED EMBODIMENTS

Hereinafter, a preferred embodiment of a transmission of an outboard motor according to the present invention will be described with reference to drawings.

Figure 1:
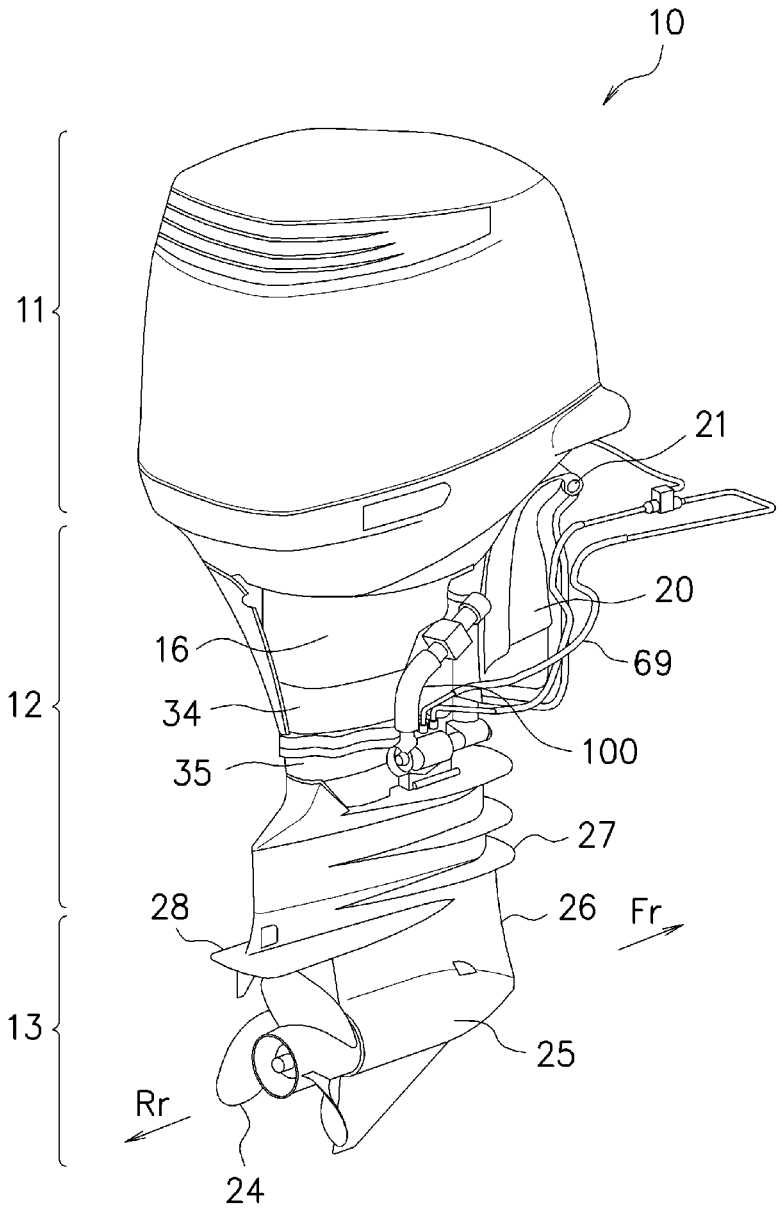
FIG. 1 is a rear perspective view illustrating an outboard motor according to the present invention.
Figure 2:
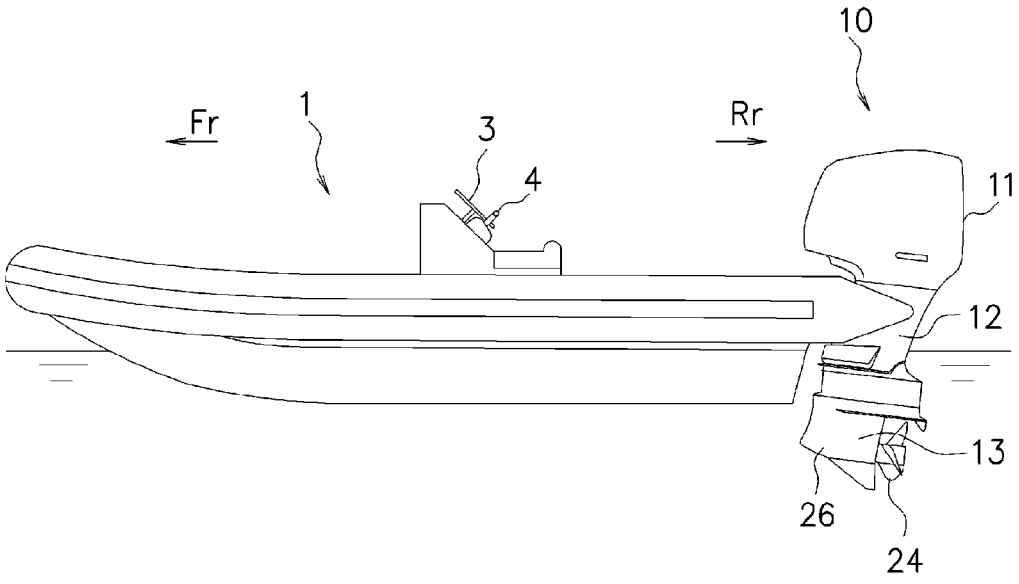
FIG. 2 is a left side view of a boat on which the outboard motor according to the present invention is mounted.
Figure 3:
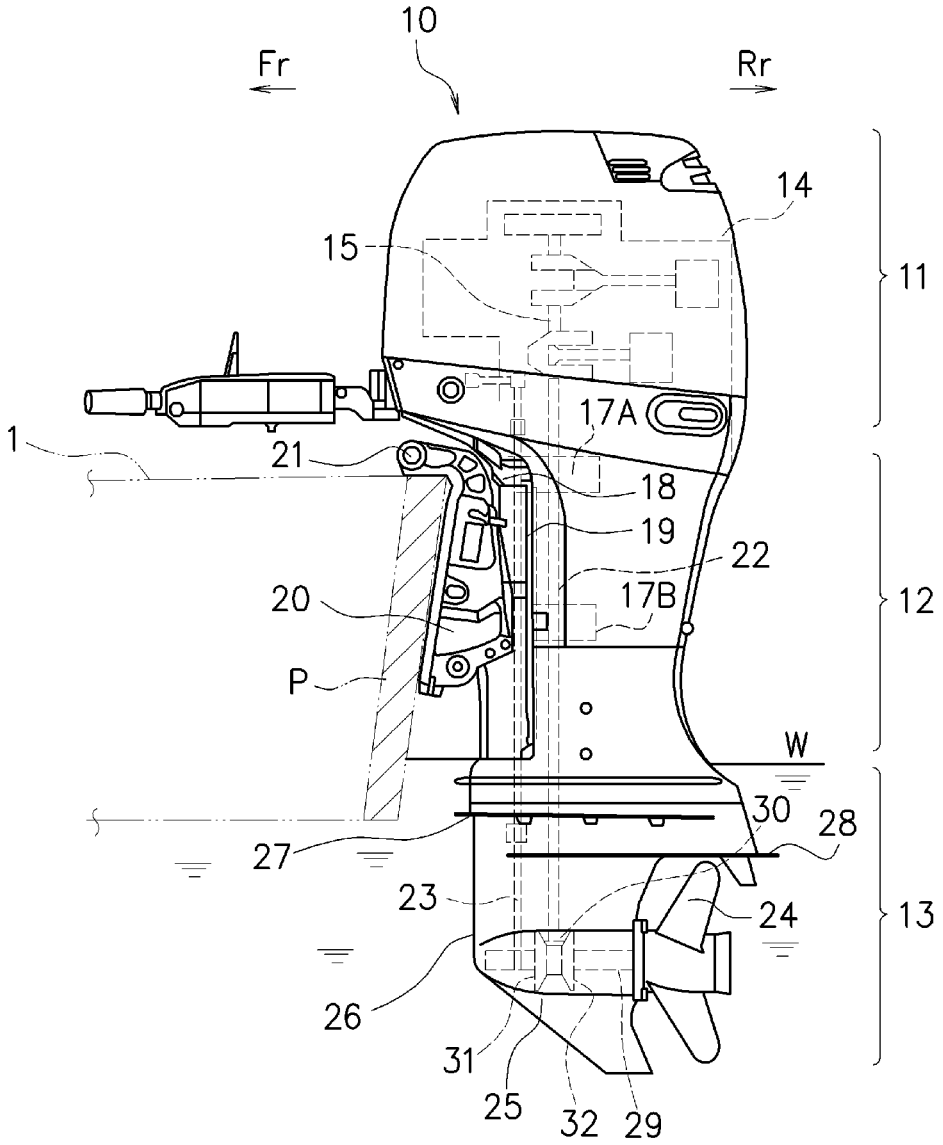
FIG. 3 is a left side view illustrating a schematic structural example of the outboard motor according to the present invention.

FIG. 1 is a rear perspective view illustrating a partially cutaway exterior of an outboard motor 10 according to the present invention. The outboard motor 10 is mounted in a rear part of the hull of a boat 1 as illustrated in FIG. 2, and in this case, at its front side, it is fixed to a stern board P of the hull of the boat 1 as illustrated in FIG. 3. Note that FIG. 3 is a left side view illustrating a schematic structural example of the outboard motor 10, and in the following description, in each drawing as necessary, the front side of the outboard motor 10 is denoted by an arrow Fr and the rear side is denoted by an arrow Rr, and further the lateral right side of the outboard motor 10 is denoted by an arrow R and the lateral left side is denoted by an arrow L.

First, the overall basic structure of the outboard motor 10 will be described. In FIG. 1 and particularly FIG. 3, an engine unit or a power unit 11, a mid unit 12, and a lower unit 13 are disposed in order from an upper part to a lower part, and these units are structured to be integrally coupled. In the engine unit 11, the engine 14 is mounted and supported vertically so that a crank shaft 15 is directed toward a vertical direction via an engine base or an engine holder. Note that as the engine 14, for example, a V-multiple cylinder engine or the like is chosen. Although the vicinity of the engine unit 11 and the mid unit 12 is covered with an exterior cover as illustrated in FIG. 1, FIG. 1 illustrates a state that part of the exterior cover of the mid unit 12 is virtually cutaway, and a drive shaft which will be described later is disposed in a drive shaft housing 16 which is schematically illustrated. Note that the engine 14 is mounted in an upper part of the drive shaft housing 16.

The mid unit 12 is supported integrally pivotally about a support shaft 19 (steering shaft) set to a swivel bracket 18 via an upper mount 17A and a lower mount 17B. A clamp bracket 20 is provided on both left and right sides of the swivel bracket 18, and it is fixed to the stern board P of the hull via this clamp bracket 20. The swivel bracket 18 is supported pivotally in a vertical direction about a support shaft 21 (tilt shaft) set in a left and right horizontal direction.

In the mid unit 12, a drive shaft 22 coupled to a lower end of the crank shaft 15 is disposed to penetrate in a vertical direction, and a driving force of this drive shaft 22 is transmitted to a propeller shaft which will be described later in a gear case of the lower unit 13. On a front side of the drive shaft 22, a shift rod 23 for switching forward and reverse, or the like is disposed in parallel in the vertical direction. The mid unit 12 has a drive shaft housing 16 which houses the drive shaft 22.

The lower unit 13 has a gear case 25 including a plurality of gears and so on for rotary driving a propeller 24 by the driving force of the drive shaft 22. The drive shaft 22 extending out downward from the mid unit 12 finally rotates the propeller 24 by meshing of a gear attached to it with a gear in the gear case 25, where a motive power transmission path in the gear device in the gear case 25 is switched, that is, shifted by operation of the shift rod 23. Further, an integrally formed casing 26 has an anti-splash plate 27 and an anti-cavitation plate 28, which are disposed vertically in the vicinity of a coupling surface with the mid unit 12, and on a lower part of the casing 26 extending downward from them, the gear case 25 disposed to exhibit a bullet shape or an artillery shell shape in a forward and backward direction is disposed.

The shift rod 23 is vertically inserted and supported in a tip side of the artillery shell shape of the gear case 25 in the casing 26. The shift rod 23 is suspended down to the position where it crosses an axial extension line of the propeller shaft 29. Further, in the vicinity of a substantially center in the forward and backward direction of the casing 26, the drive shaft 22 is inserted and supported. In the gear case 25, the propeller shaft 29 is disposed along the forward and backward direction and is rotatably supported via a plurality of bearings. On a lower end of the drive shaft 22, a drive gear 30 is attached, and on the propeller shaft 29, a front and rear pair of a forward gear 31 and a reverse gear 32 meshing with the drive gear 30 are each supported rotatably.

By a shift operation via the shift rod 23, a motive power transmission path from a forward gear 31 or reverse gear 32 to the propeller shaft 29 is formed. By start of the engine 14, output torque thereof is transmitted from the drive shaft 22 to a propelling device. That is, the outboard motor 10 generates a propulsive force by rotation of the propeller shaft 29 and the propeller 24 via the forward gear 31 or the reverse gear 32, and therefore the boat 1 in which it is mounted goes forward or backward.

Figure 4:
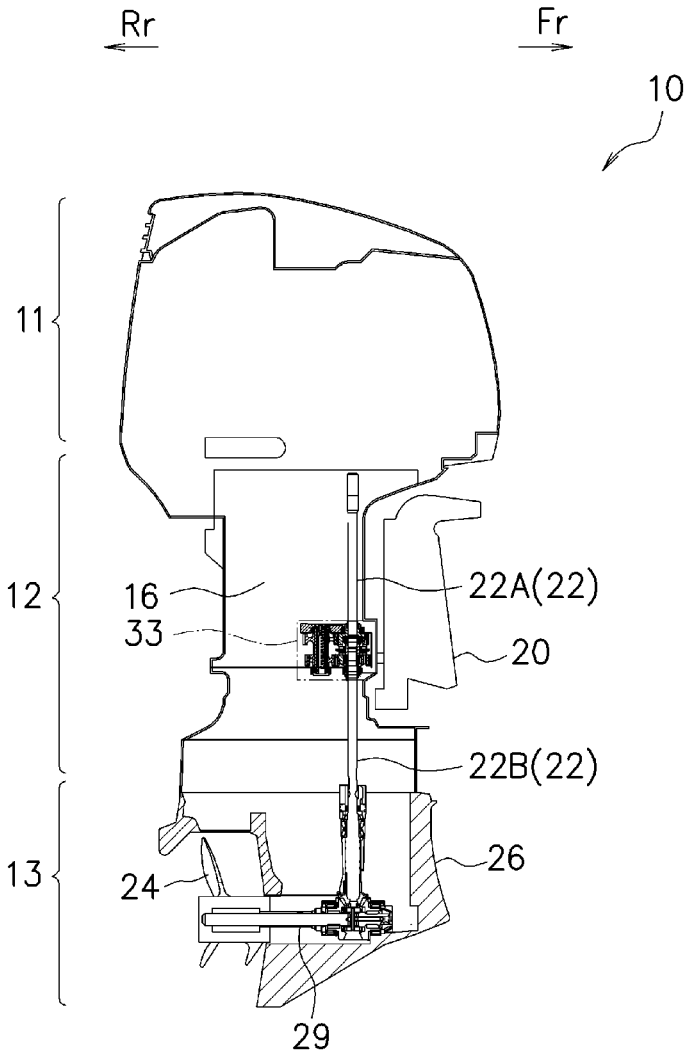
FIG. 4 is a cross-sectional view illustrating a disposition structure example of a transmission in the outboard motor according to the present invention.

In the outboard motor 10 having the above-described basic structure, in the mid unit 12 as illustrated in FIG. 4, the drive shaft 22 coupled to the lower end of the crank shaft 15 is disposed to penetrate in the vertical direction, and this drive shaft 22 is further coupled to the propeller shaft 29 in the gear case 25 of the lower unit 13. Particularly in the present invention, as in FIG. 4, the drive shaft 22 is separated vertically into a drive shaft input shaft 22A coupled to the crank shaft 15 and a drive shaft output shaft 22B driving the propeller 24. A gear type transmission 33 capable of switching between at least two high and low speed ratios is interposed between the drive shaft input shaft 22A and the drive shaft output shaft 22B.

Figure 5:
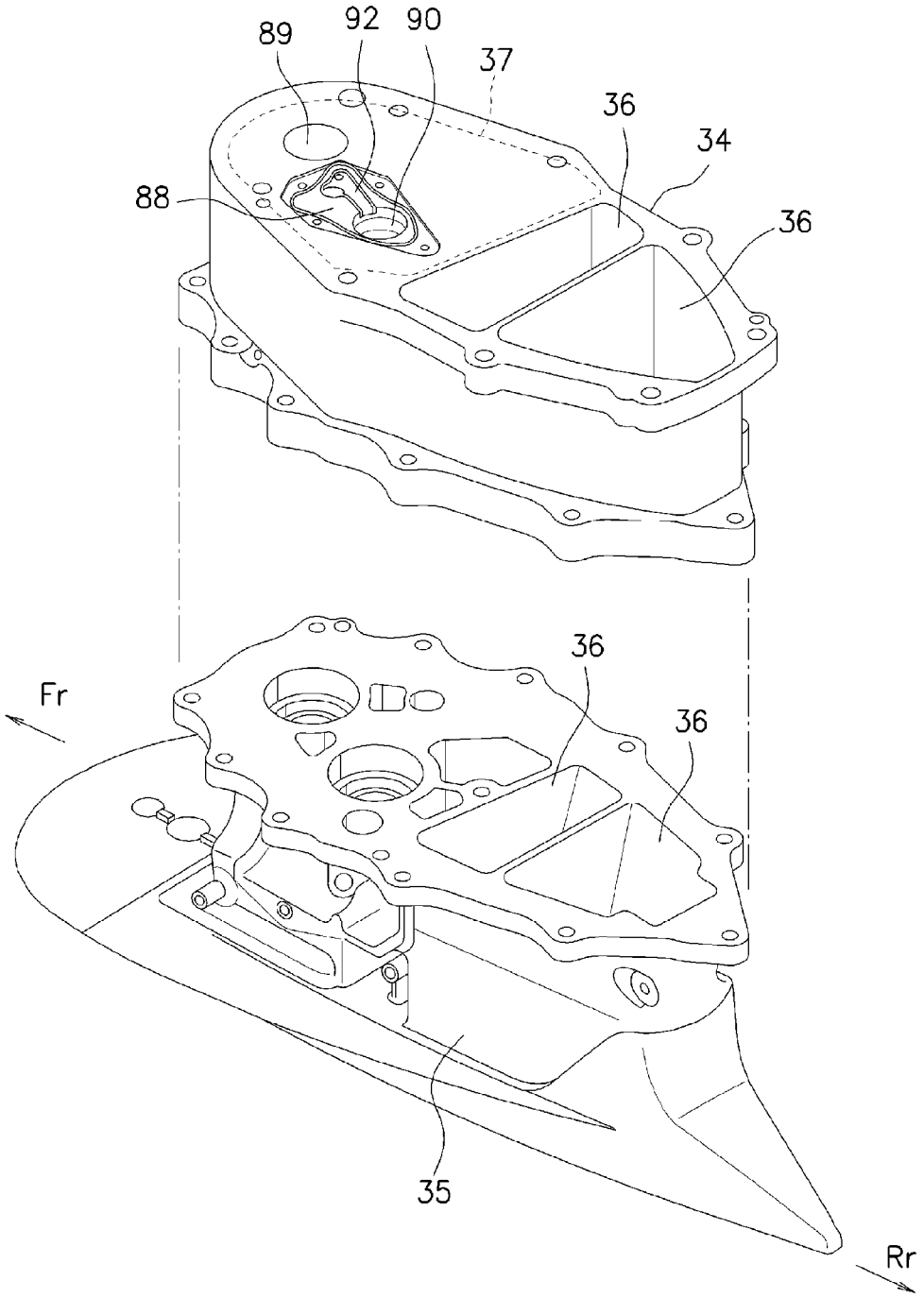
FIG. 5 is an exploded perspective view illustrating cases of the transmission in the outboard motor according to the present invention.

Below the drive shaft housing 16 in the mid unit 12, an upper case 34 and a lower case 35 for forming a transmission chamber 37, which will be described later, of the transmission 33 are integrally coupled to each other. The upper case 34 is coupled to the drive shaft housing 16, and the lower case 35 is coupled to the lower unit 13. FIG. 5 illustrates a specific structural example of the upper case 34 and the lower case 35, and the both cases are stacked vertically and have mainly in a front half part of the upper case 34 a space for forming the transmission chamber 37 of the transmission 33. Note that in a rear half part of the upper case 34 and the lower case 35, there is formed an exhaust passage 36 for allowing exhaust gas discharged from the engine 14 disposed above to flow to the lower unit 13 side below and be discharged. Here, the upper case 34 and the lower case 35 are formed separately from the drive shaft housing 16 but substantially function as part of the drive shaft housing 16, and therefore the transmission 33 itself may also be disposed and structured in the drive shaft housing 16.

Figure 6:
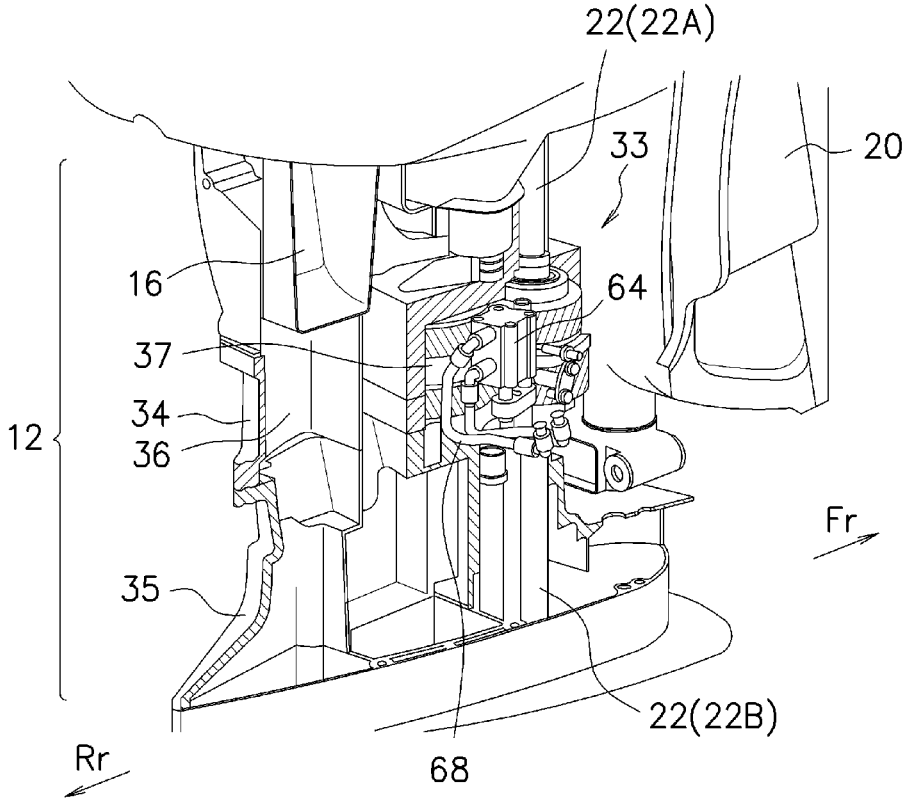
FIG. 6 is a cutaway perspective view illustrating the transmission disposed and structured in a mid unit in the outboard motor according to the present invention.
Figure 7:
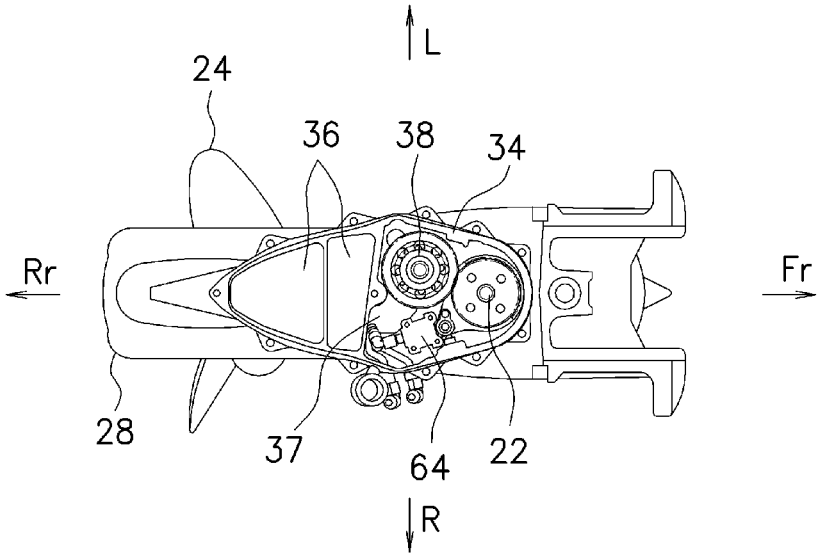
FIG. 7 is a transverse cross-sectional view of a transmission chamber in the outboard motor according to the present invention.

FIG. 6 is a cutaway perspective view illustrating the transmission 33 constituted in the upper case 34 and the lower case 35 by removing an exterior cover around the mid unit 12. As described above, in the upper case 34 and the lower case 35 coupled integrally, the transmission chamber 37 of the transmission 33 is formed, and in this transmission chamber 37, a plurality of component members of the transmission 33 are housed and disposed. The inside of the transmission chamber 37 is of a liquid-tight structure. FIG. 7 illustrates a side cross section of the transmission chamber 37, the transmission chamber 37 is disposed in the front half part of the upper case 34, and the exhaust passage 36 is formed in the rear half part thereof.

Figure 8:
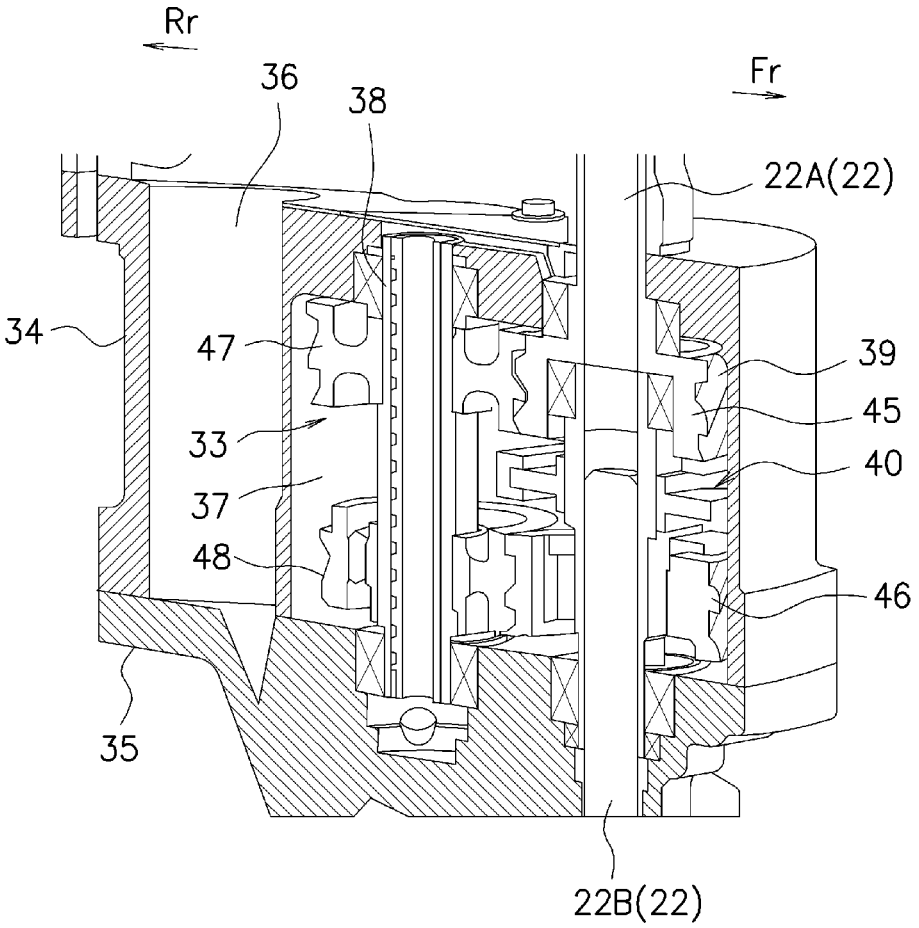
FIG. 8 is a cutaway perspective view of the transmission in the outboard motor according to the present invention.

The transmission 33 will be further described specifically using FIG. 8 and so on. The transmission 33 is housed in the transmission chamber 37 and includes a counter shaft 38 disposed in parallel with the drive shaft 22, a gear train 39 bridged between each of the drive shaft input shaft 22A and the drive shaft output shaft 22B of the drive shaft 22 and the counter shaft 38, and a dog clutch mechanism 40 capable of selectively switching a high shift speed and a low shift speed.

Particularly, a drive device 63 which will be described later driving the dog clutch mechanism 40 is constituted of a hydraulic drive device driven by a hydraulic cylinder, and this hydraulic cylinder is disposed in the transmission chamber 37.

Figure 9:
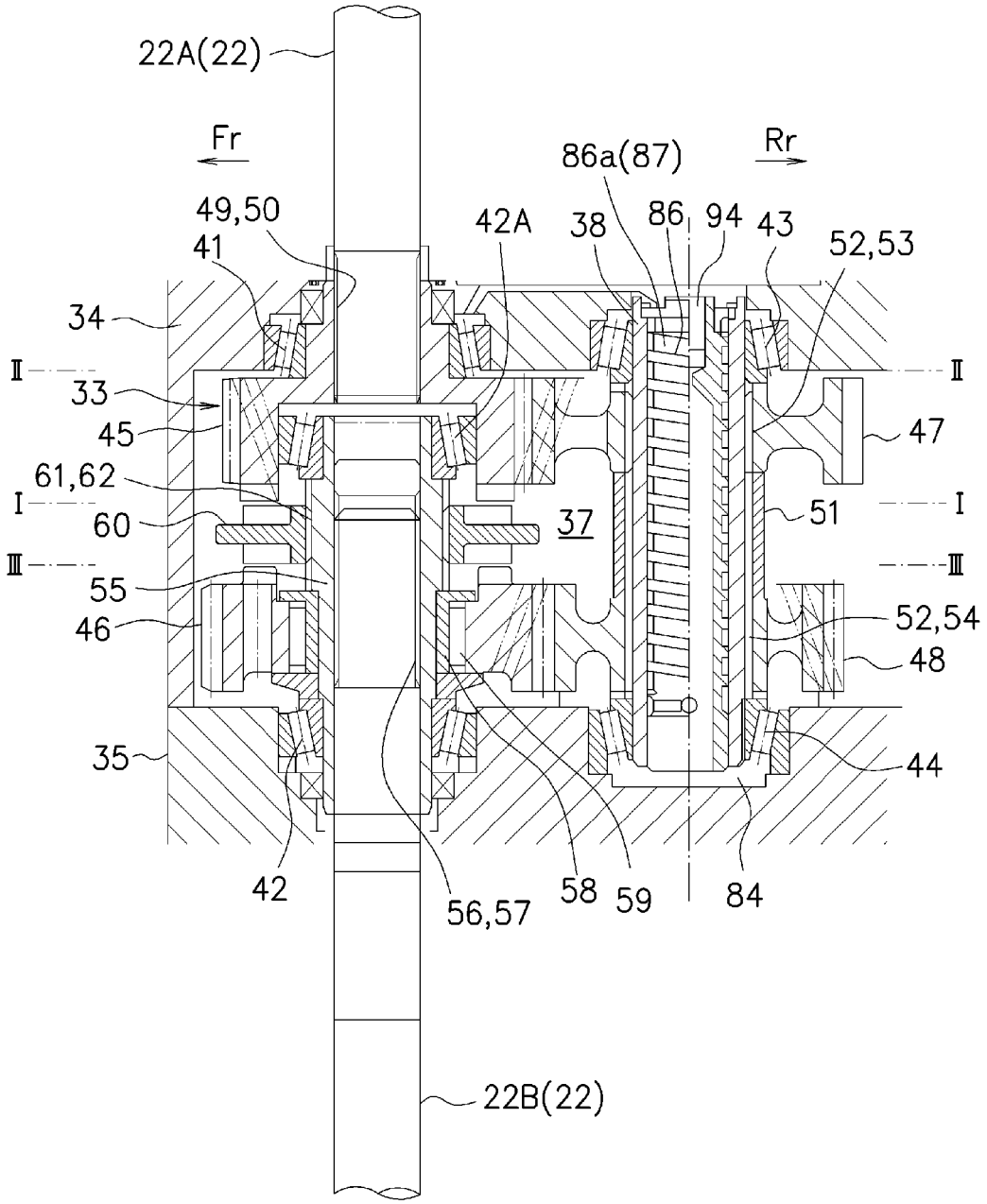
FIG. 9 is a vertical cross-sectional view of the transmission in the outboard motor according to the present invention.

With further reference to FIG. 9, the drive shaft input shaft 22A is inserted from above into a substantially center part in a left and right direction near a front side of the transmission chamber 37, and supported rotatably at its lower end on the upper case 34 indirectly via a bearing 41 (which hereinafter means a tapered roller bearing unless otherwise mentioned). At a position immediately below the drive shaft input shaft 22A, the drive shaft output shaft 22B is supported rotatably at its upper end on the lower case 35 indirectly via a bearing 42. Further, the counter shaft 38 is supported rotatably at its upper and lower ends on the upper case 34 and the lower case 35, respectively, via bearings 43, 44.

The gear train 39 includes a main drive gear 45 provided integrally rotatably on the drive shaft input shaft 22A, a main driven gear 46 axially supported rotatably on the drive shaft output shaft 22B, a counter driven gear 47 meshing with the main drive gear 45 and provided integrally rotatably on the counter shaft 38, and a counter drive gear 48 provided integrally rotatably on the counter shaft 38 and meshing with the main driven gear 46.

A spline (male) 49 formed in the lower end of the drive shaft input shaft 22A and a spline (female) 50 formed in a boss part of the main drive gear 45 engage with each other, by which the drive shaft input shaft 22A and the main drive gear 45 are coupled integrally rotatably. Further, a spacer 51 is interposed between the counter driven gear 47 and the counter drive gear 48, restricting an interval between both the gears, that is, a vertical direction position. Splines (male) 52 are formed in the portions corresponding to the counter driven gear 47 and the counter drive gear 48 of the counter shaft 38, splines (female) 53, 54 are formed in the counter driven gear 47 and the counter drive gear 48, respectively, and these splines 52 and 53, 54 engage with each other, by which the counter shaft 38 and the counter driven gear 47 or the counter drive gear 48 are coupled integrally rotatably. Accordingly, the gear train 39 constituted of the main drive gear 45, the counter driven gear 47, the counter drive gear 48, and the main driven gear 46 is retained in a constantly connected state.

A hollow idle shaft 55 is externally fitted to the upper end of the drive shaft output shaft 22B, and in this case a spline (male) 56 formed in the drive shaft output shaft 22B and a spline (female) 57 formed in the idle shaft 55 engage with each other, by which the drive shaft output shaft 22B and the idle shaft 55 are coupled integrally rotatably. Further, a bearing (needle bearing) 59 is fitted between an inner sleeve 58 externally fitted to the idle shaft 55 and the main driven gear 46, and the main driven gear 46 is rotatable in relation with the drive shaft output shaft 22B. Note that a bearing 42A is fitted between an upper end of the idle shaft 55 and the main drive gear 45.

Each gear of the gear train 39 is constituted of a helical gear. In this case, a helix angle of the helical gear is set so that a thrust reactive force operating on the mutually engaged main drive gear 45 and counter driven gear 47 and a thrust reactive force operating on the mutually engaged main driven gear 46 and counter drive gear 48 counter each other.

Further, given that a gear ratio between the main drive gear 45 and the counter driven gear 47 is $Gr_1$ and a gear ratio between the main driven gear 46 and the counter drive gear 48 is $Gr_2$, the speed reducing ratio R in the entire gear train 39 is $Gr_1 \times Gr_2$.

The dog clutch mechanism 40 has a dog clutch 60 externally fitted with the idle shaft 55 and supported vertically reciprocatably along an axial direction of the idle shaft 55 between the main drive gear 45 and the main driven gear 46. A spline (male) 61 formed in the idle shaft 55 and a spline (female) formed in the dog clutch 60 engage with each other, by which the idle shaft 55 and the dog clutch 60 are coupled integrally rotatably. As described above, the drive shaft output shaft 22B and the idle shaft 55 are coupled integrally rotatably, and therefore the three parts of the dog clutch 60, the idle shaft 55, and the drive shaft output shaft 22B couple integrally rotatably.

A drive device vertically moving the dog clutch 60, which will be described later, moves upward to engage with the main drive gear 45 (upper engagement position) and moves downward to engage with the main driven gear 46 (lower engagement position). Then, the transmission 33 is structured to switch between a high shift speed and a low shift speed by the dog clutch 60 sliding up and down, and a lower engagement position of the dog clutch 60 is set to the low shift speed. In FIG. 9, a neutral position of the dog clutch 60 is illustrated, from which the dog clutch 60 engages with the main drive gear 45 by moving upward, and in this case, the drive shaft input shaft 22A and the drive shaft output shaft 22B are directly coupled via the main drive gear 45 and the dog clutch 60. Further, by the dog clutch 60 moving downward, the dog clutch 60 engages with the main driven gear 46, and in this case, the drive shaft input shaft 22A and the drive shaft output shaft 22B are connected at the speed reducing ratio R via the motive power transmission path formed through the main drive gear 45, the counter driven gear 47, the counter drive gear 48, and the main driven gear 46.

Figure 10:
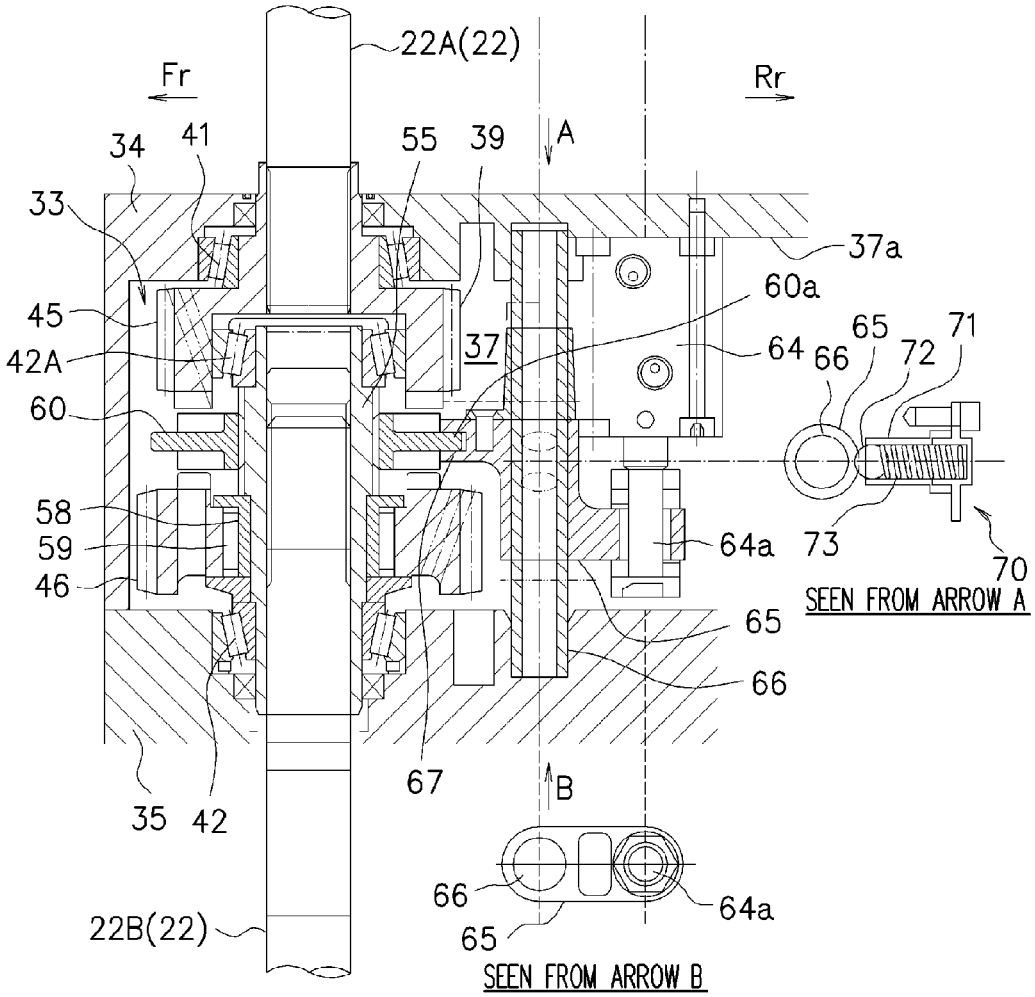
FIG. 10 is a vertical cross-sectional view of the transmission in the outboard motor according to the present invention.

The drive device 63 of the transmission 33 is constituted of a hydraulic drive device driven by a hydraulic cylinder. This hydraulic drive device includes an electric hydraulic pump, and the hydraulic cylinder is actuated by hydraulic pressure generated by this hydraulic pump. As illustrated in FIG. 10, the drive device has a hydraulic cylinder 64 whose cylinder axis is set in the vertical direction, and in this example, a cylinder body of the hydraulic cylinder 64 is fixedly supported to a ceiling part 37*a* of the transmission chamber 37. The hydraulic cylinder 64 and the dog clutch 60 are coupled via a slide yoke 65 disposed between them. In this case, the slide yoke 65 is supported vertically slidably along a guide shaft 66 suspended in the transmission chamber 37, and one end side is coupled to an output rod 64*a* of the hydraulic cylinder 64. Thus, the slide yoke 65 is moved up and down by the hydraulic cylinder 64.

Figure 11:
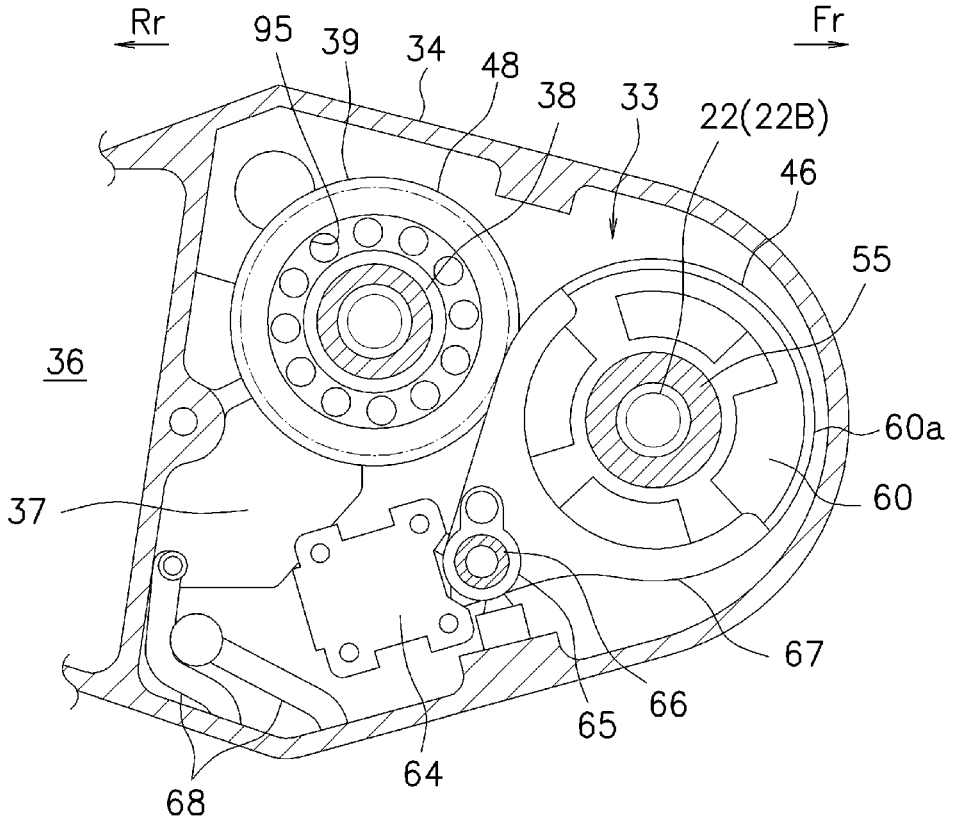
FIG. 11 is a cross-sectional view along a line I-I of FIG. 9.

Further, a shift fork 67 is attached to the other end side of the slide yoke 65, and this shift fork 67 extends out to the dog clutch 60 side to engage therewith. Specifically, the dog clutch 60 exhibits a substantially circular shape in plan view as illustrated in FIG. 11 and so on, and a flange part 60*a* is provided to project along an outer peripheral edge thereof as in FIG. 10 and FIG. 11. The shift fork 67 exhibits an arc shape in a plan view as illustrated in FIG. 11, and engages with the flange part 60*a* so as to sandwich it from both upper and lower sides (FIG. 10).

Figure 12:
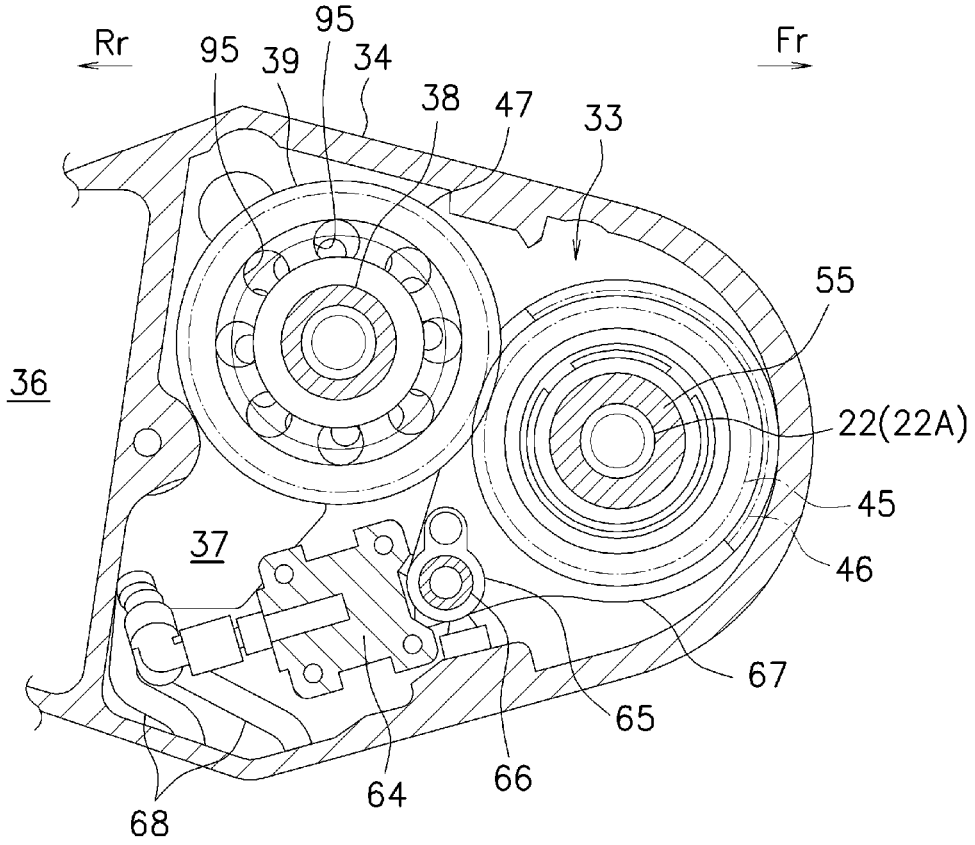
FIG. 12 is a cross-sectional view along a line II-II of FIG. 9.

Here, as illustrated in FIG. 11 or FIG. 12, the drive shaft 22 (the drive shaft input shaft 22A and the drive shaft output shaft 22B) is disposed in a center portion in the left and right direction of a forefront part of the transmission chamber 37. Further, the counter shaft 38 and the hydraulic cylinder 64 are offset to left and right, respectively, behind the drive shaft 22 and disposed in a triangle shape in plan view. That is, the three parts of the drive shaft 22, the counter shaft 38, and the hydraulic cylinder 64 are in a disposition relation not aligning straight in the forward and backward direction or the left and right direction.

A hydraulic piping 68 is connected to the hydraulic cylinder 64 as in FIG. 6, and pressure oil flows into or out of the hydraulic cylinder 64 via the hydraulic piping 68. The hydraulic piping 68 in the immediate vicinity of the hydraulic cylinder 64 is housed in the exterior cover, but an electric hydraulic pump, an electromagnetic changeover valve, and the like excluding the hydraulic cylinder 64 in the drive device 63 of the transmission 33 are disposed outside the outboard motor 10, that is, on the hull side of the boat 1. In this case, the hydraulic piping 68 and the hydraulic pump on the hull side are connected via hydraulic hoses 69 illustrated in FIG. 1.

Figure 13:
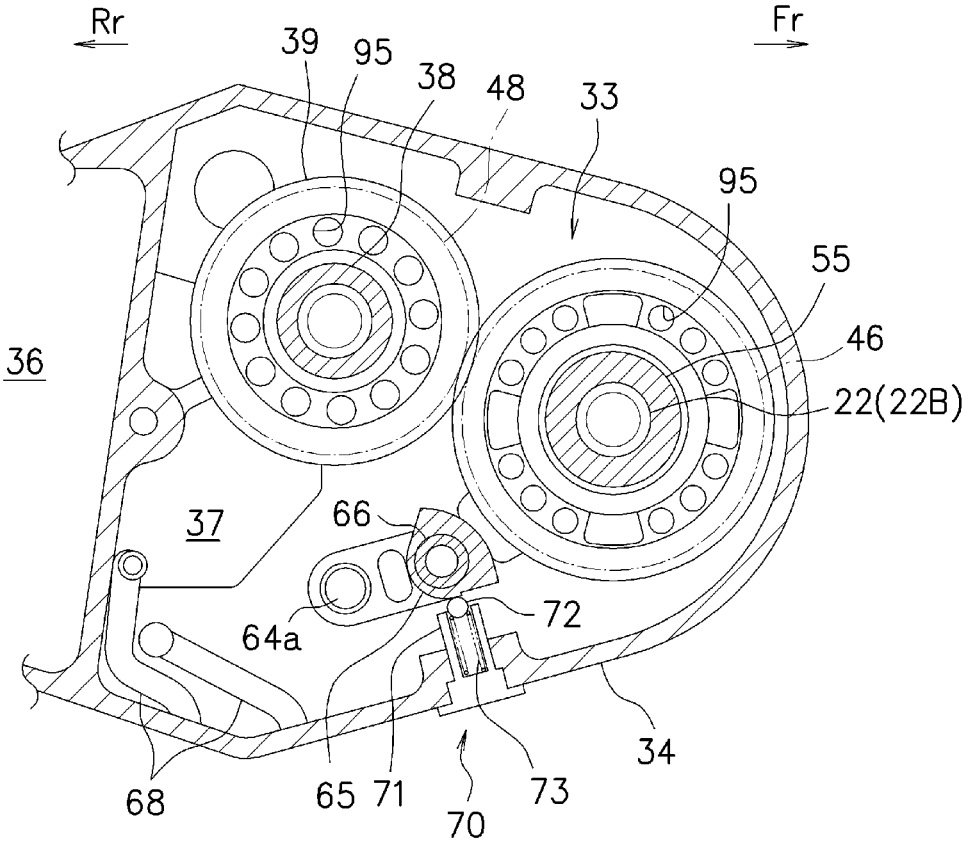
FIG. 13 is a cross-sectional view along a line of FIG. 9.

In the transmission 33, a detent device 70 can be provided which retains the moving position of at least the slide yoke 65 to an upper engagement position of the dog clutch 60, as illustrated in FIG. 13. With reference also to FIG. 10 (seen from arrow A), the detent device 70 has a detent holder 71 fixed to a wall side of the upper case 34 and provided to project to the slide yoke 65 side, and a ball 72 attached to this detent holder 71 is in resilient contact with an outside surface of the slide yoke 65 by resilience of a spring 73. Note that this detent device 70 can be provided selectively as necessary.

Figure 14:
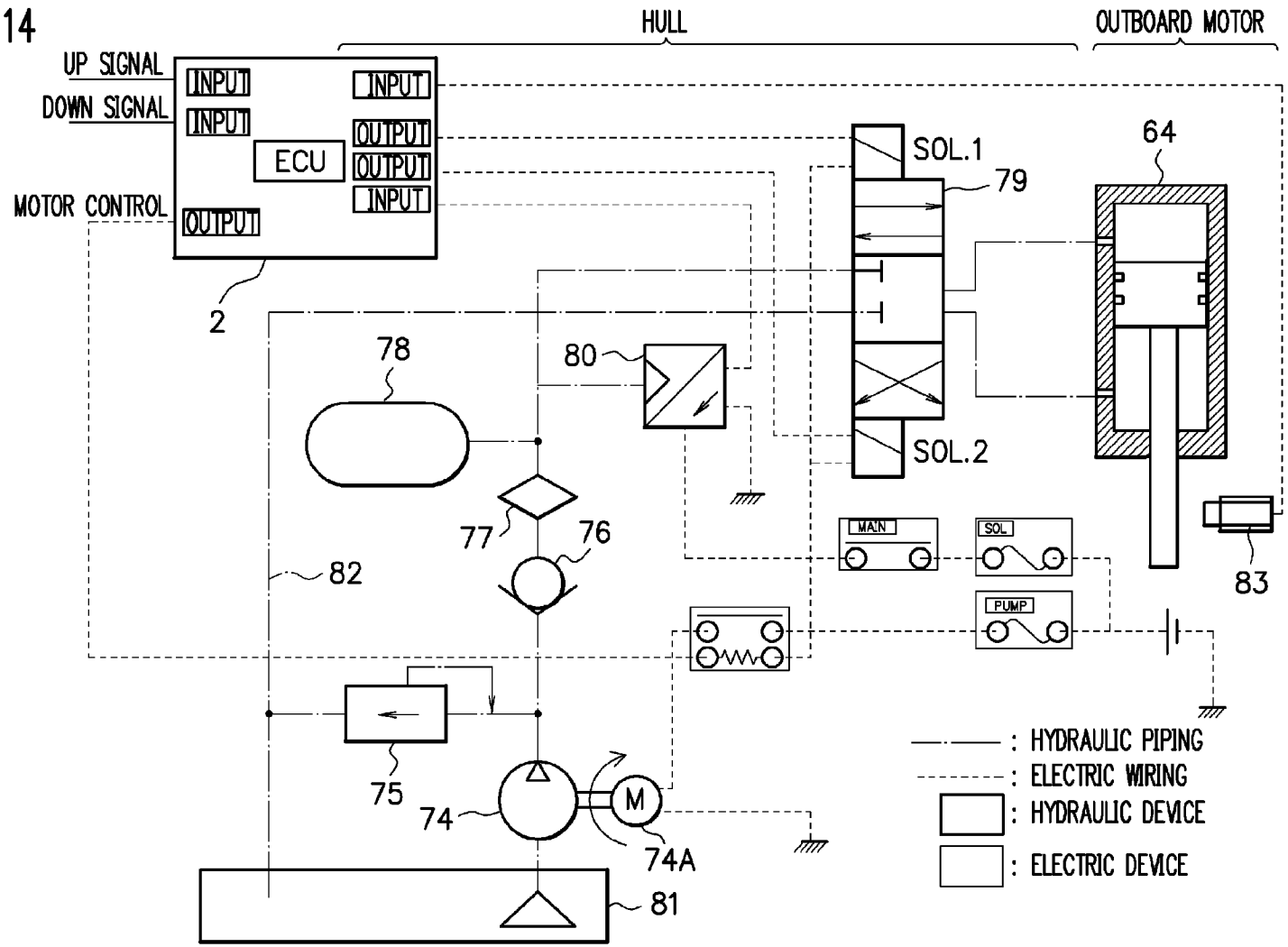
FIG. 14 is a block diagram illustrating a structural example of the transmission in the outboard motor according to the present invention.

FIG. 14 illustrates an overall structural example of the drive device 63. In the hydraulic system including the hydraulic cylinder 64, a hydraulic pump 74 driven by an electric motor 74A, a regulator 75 performing hydraulic adjustment, a one-way valve 76, a filter 77, an accumulator 78, a solenoid valve 79, a hydraulic sensor 80, and a reservoir tank 81 are connected as illustrated via a hydraulic piping 82. These component members are mounted on the hull side, and the solenoid valve 79 and the hydraulic cylinder 64 are connected via the hydraulic hose 69 as described above. The solenoid valve 79 and so on are actuated and controlled by an ECU (Engine Control Unit) 2 provided on the hull side. A stroke sensor 83 is attached to the hydraulic cylinder 64, this stroke sensor 83 detects at least an operating stroke end of the hydraulic cylinder 64, and a detection signal thereof is sent to the ECU 2. Note that as illustrated in FIG. 1, a steering device 3, a remote control device 4, and so on are disposed on an operator's seat of the boat 1, and according to operations of them, the drive device 63 is controlled via the ECU 2.

In the basic operation of the transmission 33 of the above-described structure, the dog clutch 60 is moved upward from the neutral position of FIG. 9 by, for example, the shift fork 67 via the slide yoke 65 by actuating the hydraulic cylinder 64. In this case, the dog clutch 60 is engaged with the main drive gear 45, the drive shaft input shaft 22A and the drive shaft output shaft 22B are directly coupled via the main drive gear 45 and the dog clutch 60, and the transmission 33 shifts to the high shift speed. On the other hand, when the solenoid valve 79 is switched to actuate the hydraulic cylinder 64 in a direction reverse to the above described direction, the dog clutch 60 moves downward from the neutral position of FIG. 9. In this case, the drive shaft input shaft 22A and the drive shaft output shaft 22B are connected at the speed reducing ratio R via the gear train 39. By thus sliding the dog clutch 60 up and down in the transmission 33, it is possible to appropriately slide to the high shift speed and the low shift speed.

By thus providing the transmission 33 in middle of the drive shaft 22, power performance, fuel consumption performance, and the like can be improved. Further, since the hydraulic cylinder 64 is disposed in the transmission chamber 37, there is no concern that the hydraulic cylinder 64 is exposed to sea water, and thus durability of the device can be improved largely.

In the present invention, a lubrication system for lubricating the transmission 33 is further provided, and lubrication oil is supplied to respective parts of the transmission 33 which need lubrication, such as the gear train 39, the dog clutch mechanism 40, and so on. This lubrication system will be described next.

Figure 15:
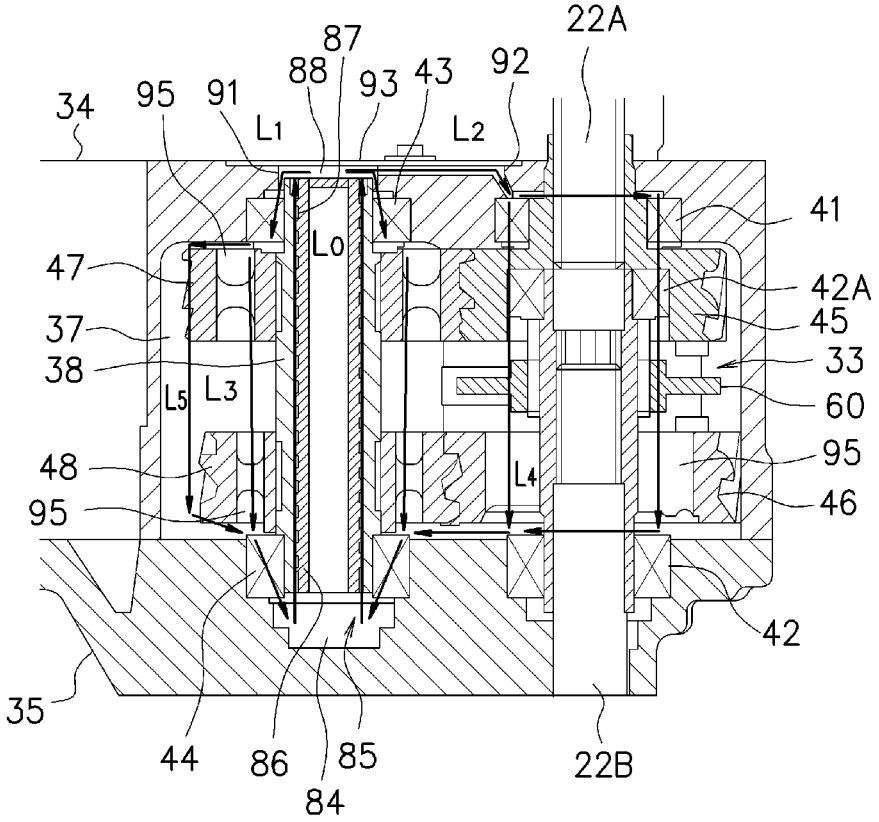
FIG. 15 is a cross-sectional view illustrating a structural example of a lubrication system of the transmission according to the present invention.
Figure 16:
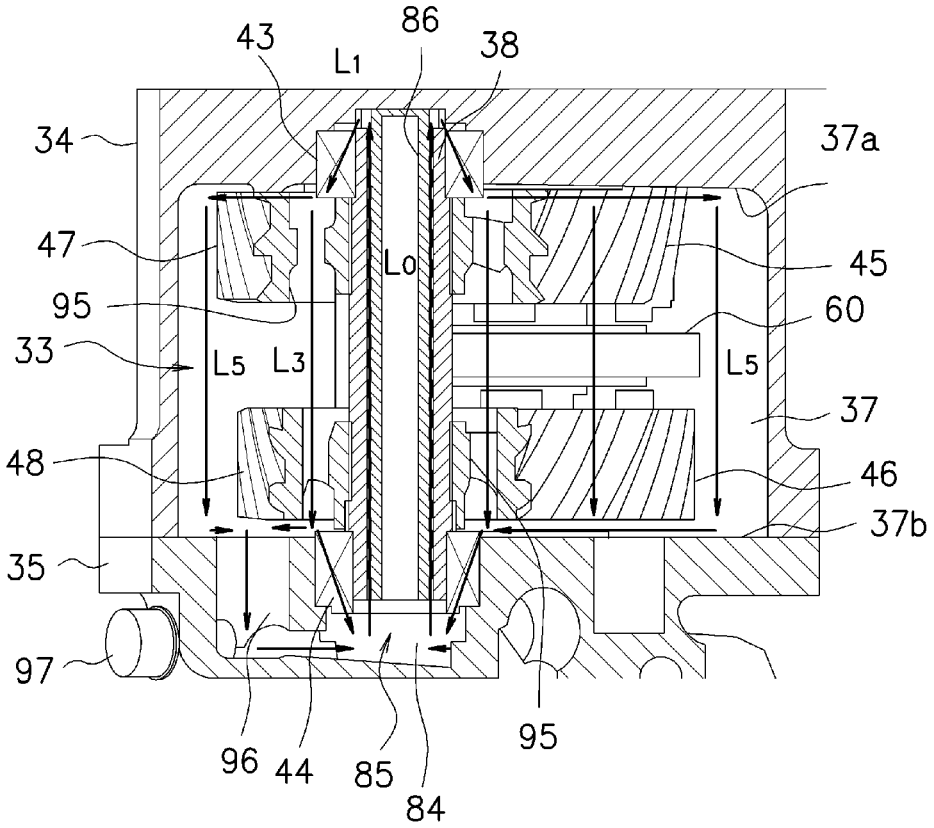
FIG. 16 is a cross-sectional view illustrating a structural example of a lubrication system of the transmission according to the present invention.

In FIG. 15 and FIG. 16, in a lower part of the bearing 44 as a lower bearing of the counter shaft 38 in a bottom part 37*b* of the transmission chamber 37, a lower reserve part 84 of lubrication oil reserving lubrication oil flowed down via this bearing 44 is provided. Then, there is provided a lubrication oil pump 85 which pumps up the lubrication oil from this lower reserve part 84 and sends it to respective parts of the transmission 33.

The lubrication oil pump 85 is constituted of a helical pump formed by making a spiral trench in a hollow inside of the counter shaft 38. More specifically, in the hollow inside of the counter shaft 38, a helical stator 86 constituted of a separate cylinder penetrating vertically is inserted. Note that an upper end of the helical stator 86 is screwed into a screw part formed in an upper inside wall of the upper case 34. Lower ends of the counter shaft 38 and the helical stator 86 are dipped in the lower reserve part 84. As illustrated also in FIG. 9, in an outer periphery of the helical stator 86, a spiral recessed trench 86*a* in a spiral shape is formed, and a spiral lubrication oil passage 87 is formed between this recessed trench 86*a* and the hollow inside surface of the counter shaft 38. With the spiral pump having such a helical lubrication oil passage 87, rotation of the counter shaft 38 causes the lubrication oil reserved in the lower reserve part 84 to climb up along the lubrication oil passage 87 (FIG. 15, arrow $L_0$).

Note that here, in this example, the spiral recessed trench 86*a* is formed in a left screw direction in the outer periphery of the helical stator 86 as illustrated in FIG. 9 and so on. On the other hand, the rotation direction of the counter shaft 38 is set counterclockwise in plan view, and when the counter shaft 38 rotates, the lubrication oil climbs up the lubrication oil passage 87 by its own shear resistance.

The pumped up lubrication oil overflows from the upper end of the helical stator 86, and flows into an upper reserve part 88 of lubrication oil formed in an upper part of the counter shaft 38. Here, as illustrated in FIG. 5, insertion holes 89, 90 of the drive shaft 22 and the counter shaft 38, respectively, are formed in the upper case 34. The upper reserve part 88 provided on the upper side of the insertion hole 90 of the counter shaft 38 is formed to expand toward the insertion hole 89 of the drive shaft 22. Moreover, lubrication oil passages 91, 92 supplying the pumped up lubrication oil from the upper reserve part 88 to the bearings 43, 41, which are bearings of the counter shaft 38 and the drive shaft input shaft 22A, respectively, are formed in the form of communicating with the upper reserve part 88.

A lid plate 93 is laid over the upper reserve part 88 as illustrated in FIG. 15, and lubrication oil passages 91, 92 are blocked from the outside of the upper case 34. Further, although the helical stator 86 has a hollow structure, a plug 94 is fitted onto the upper end thereof (see FIG. 9), preventing the lubrication oil from falling into the hollow inside from the upper end of the helical stator 86. Accordingly, the lubrication oil passes through the lubrication oil passages 91, 92 from the upper reserve part 88 and is supplied to the bearings 43, 41, respectively, as indicated by arrow $L_1$ and arrow $L_2$ of FIG. 15.

Here, in each of the main drive gear 45, the main driven gear 46, the counter driven gear 47, and the counter drive gear 48 constituting the gear train 39, a plurality of thinning holes 95 are formed to penetrate in a face width direction as illustrated in FIG. 11 to FIG. 13. Part of the lubrication oil supplied to the bearing 43 passes through the respective thinning holes 95 of the counter driven gear 47 and the counter drive gear 48 (FIG. 15, arrow $L_3$) and sequentially drops down, and meanwhile lubricates their tooth surfaces and surrounding members. Further, part of the lubrication oil supplied to the bearing 41 passes through the respective thinning holes 95 of the main drive gear 45 and the main driven gear 46 and sequentially drops down to the bearing 42A (FIG. 9), the shift fork 67, the dog clutch 60, and the bearing 59 (needle bearing) (FIG. 15, arrow $L_4$), and meanwhile lubricates their tooth surfaces and surrounding members.

Further, another part of the lubrication oil supplied to the bearing 43 and the bearing 41 flows on upper surfaces of the counter driven gear 47 and the main drive gear 45 and drops down or scatters from their outer peripheral parts, as indicated by arrow $L_5$ of FIG. 16. Also in the case of such dropping down or scattering, it lubricates their tooth surfaces and surrounding members.

As described above, the lubrication oil supplied from the upper reserve part 88 to the bearings 43, 41 passes through passages as indicated by arrow $L_1$ to arrow $L_5$ of FIG. 15 or FIG. 16 thereafter, and drops down or scatters in the transmission chamber 37. In this case, typical passages which the lubrication oil passes through are indicated or illustrated, and by this lubrication system, in general, the lubrication oil can be delivered evenly to small portions in the transmission chamber 37.

The lubrication oil which lubricated the respective parts of the transmission chamber 37 drops down to the bottom part 37*b* of the transmission chamber 37, but mutually communicates with the bottom part 37*b* and the lower reserve part 84 via a communication hole 96 as illustrated in FIG. 16. The lubrication oil used for lubricating the transmission 33 is, after it drops down to the bottom part 37*b* of the transmission chamber 37, collected in the lower reserve part 84 and pumped up by the lubrication oil pump 85 and used again as described above. Note that a plug 97 is installed in and blocks the communication hole 96 as illustrated in FIG. 16.

Next, characteristic operation and effect of the transmission 33 in the outboard motor 10 of the present invention will be described. First, in the lower part of the bearing 44 of the counter shaft 38 in the bottom part 37*b* of the transmission chamber 37, the lower reserve part 84 of lubrication oil which flowed down through this bearing 44 is provided, and the lubrication oil pump 85 pumping up the lubrication oil from this lower reserve part 84 and sending the lubrication oil is provided.

By providing the lower reserve part 84 of lubrication oil as described above, the surroundings of particularly the main driven gear 46, the counter drive gear 48, and their bearings 42, 44 disposed in the lower part of the transmission chamber 37 are bathed in the lubrication oil in the lower reserve part 84 and lubricated. Accordingly, without requiring any special supply device of lubrication oil, that is, while simplifying the structure, necessary positions can be lubricated appropriately. At this time, the lubrication oil is not filled in the transmission chamber 37, that is, a constant amount of lubrication oil is circulated by the lubrication oil pump 85, and thus there occurs less stirring resistance of the lubrication oil.

Further, the lubrication oil pump 85 is structured by forming a spiral pump by making the counter shaft 38 hollow and providing the spiral recessed trench 86*a* therein.

In this manner, without providing any special device, the lubrication oil pump 85 can be realized with a simple structure. By operation of the spiral pump, the lubrication oil can be guided easily and appropriately from the lower reserve part 84 to the upper bearing 43.

Further, the spiral lubrication oil passage 87 is formed between the recessed trench 86*a* in the outer periphery of the helical stator 86 and the hollow inner surface of the counter shaft 38.

Since the spiral recessed trench 86*a* is formed in the separate helical stator 86 which does not need mechanical strength as compared to the counter shaft 38, formation of the spiral recessed trench 86*a* is easy and quite advantageous in terms of manufacturing. Moreover, a cross section of such a spiral trench can be made as a closed cross section of "□" (square) or "○" (circle) shape instead of a U shape, and thus pump efficiency improves.

Further, the lubrication oil pump 85 pumps up the lubrication oil to the upper reserve part 88 of lubrication oil through the hollow inside of the counter shaft 38, and is supplied to the bearings 43, from this upper reserve part 88 of lubrication oil.

Without providing any special device, the lubrication oil can be guided to the bearing 41 above the main drive gear 45 from the upper reserve part 88. Further, the lubrication oil which lubricated the bearing 41 above the main drive gear 45 can lubricate the main drive gear 45 and the counter driven gear 47 meshing therewith by scattering without any special lubrication oil supply device.

Figure 17A:
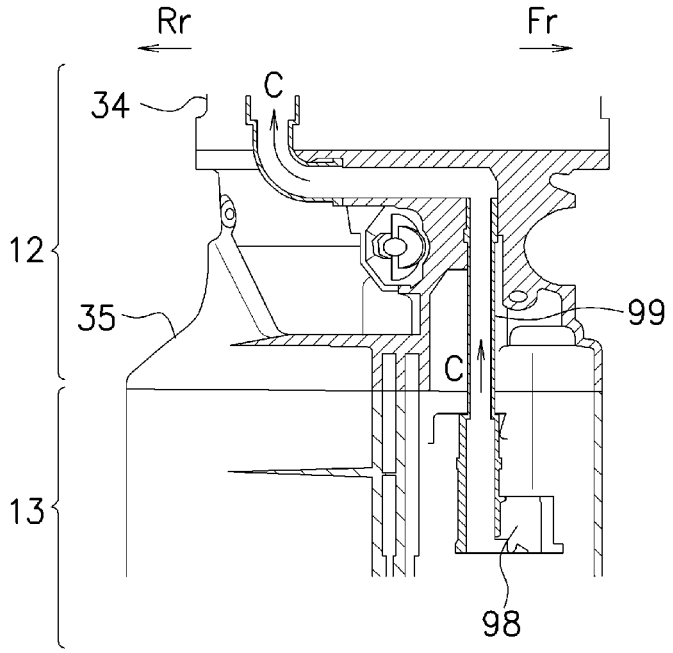
FIG. 17A is a cross-sectional view illustrating a structural example of a cooling system in the outboard motor according to the present invention.
Figure 17B:
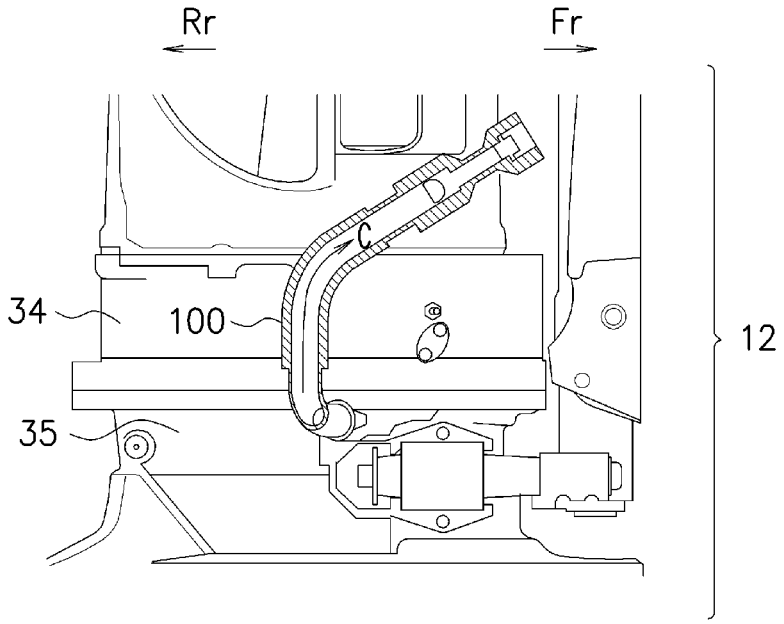
FIG. 17B is a cross-sectional view illustrating a structural example of a cooling system in the outboard motor according to the present invention.

Further, in the present invention, a cooling system for cooling the engine 14 is further provided. Here, the cooling system will be described schematically in relation with the transmission 33. In the lower unit 13, a cooling water pump 98 is disposed as schematically illustrated in FIG. 17A, and a cooling water pipe 99 extends out upward into the lower case 35 from this cooling water pump 98. Note that in the following diagram, a flow of cooling water in the cooling system is indicated by arrow C. The cooling water pipe 99 once goes outside from a side part of the lower case 35 and is connected to a cooling water hose 100 as illustrated in FIG. 17B. As also illustrated in FIG. 1, the cooling water hose 100 detours the cases of the transmission 33, particularly the upper case 35, and is connected to a cooling water introducing passage 101 in the mid unit 12 as illustrated in FIG. 18.

Figure 18:
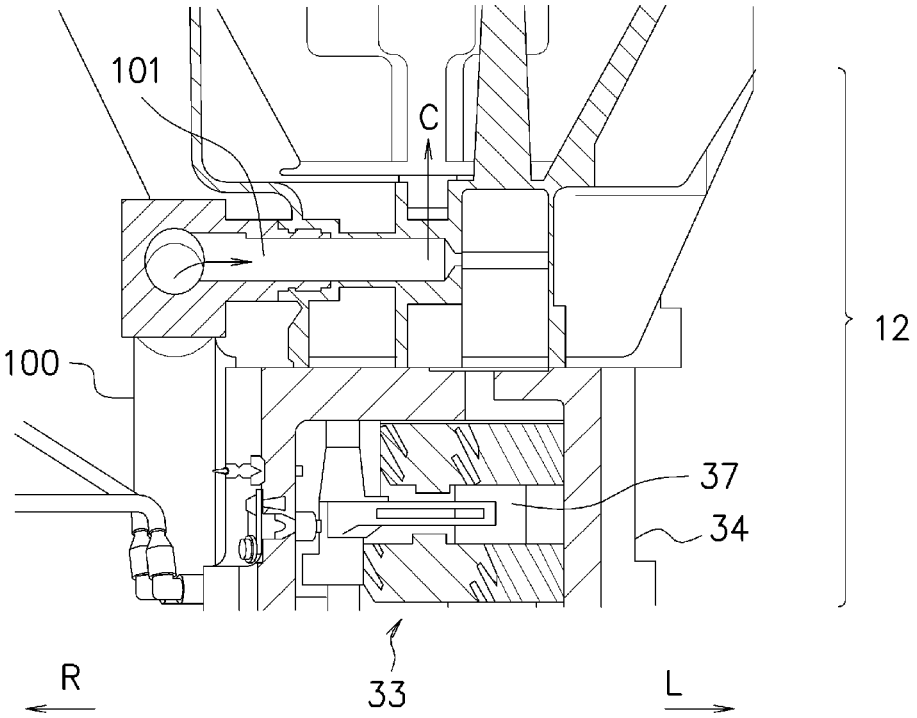
FIG. 18 is a cross-sectional view illustrating a structural example of the cooling system in the outboard motor according to the present invention.
Figure 19A:
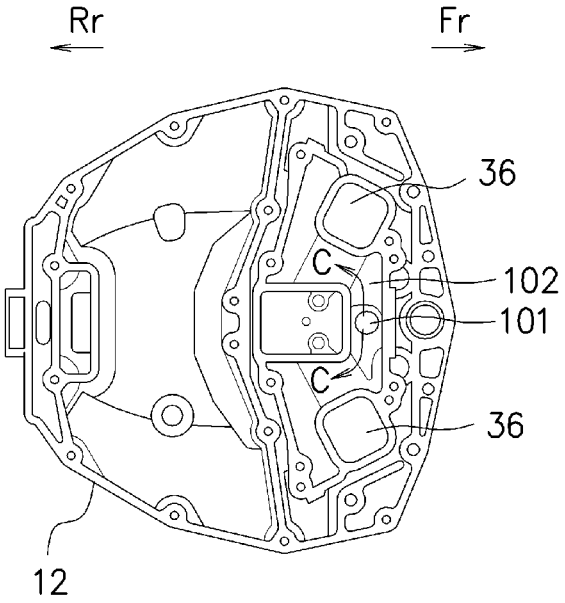
FIG. 19A is a cross-sectional view illustrating a structural example of the cooling system in the outboard motor according to the present invention.
Figure 19B:
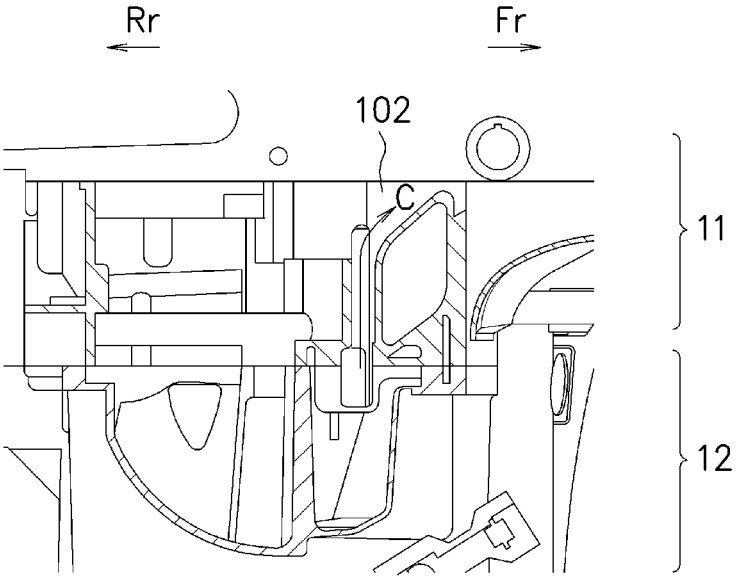
FIG. 19B is a cross-sectional view illustrating a structural example of the cooling system in the outboard motor according to the present invention.

The cooling water introducing passage 101 goes up in the mid unit 12 as in FIG. 18 and is connected to a cooling water passage 102 in the vicinity of the lower end of the upper unit 11 as in FIG. 19A. The cooling water which flowed into the cooling water passage 102 thereafter goes up in the upper unit 11 as illustrated in FIG. 19B, and flows around and cools an exhaust manifold and a cylinder block.

In this cooling system, the cooling water pipe 99 goes outside from the side part of the lower case 35 and is connected to the cooling water hose 100, but is covered by the exterior cover and is not exposed on the external appearance. The transmission 33 is disposed in middle of the drive shaft 22 in the mid unit 12, but since the transmission 33 is structured quite compactly, an existing exterior cover can be used even when the cooling water hose 100 is disposed in a detouring manner.

In the foregoing, the present invention has been described together with various embodiments, but the present invention is not limited only to these embodiments. Changes and the like can be made within the range of the present invention.

In the above-described embodiments, an example of forming the spiral recessed trench 86*a* in the left screw direction in the outer periphery of the helical stator 86 is described, but it is also possible to form it in a right screw direction and set the rotation direction of the counter shaft 38 to the reverse direction corresponding to this.

According to the present invention, by providing the lower reserve part of lubrication oil, the surroundings of particularly gears and their bearings disposed in the lower part of the transmission chamber are bathed and lubricated in lubrication oil in the lower reserve part. Thus, without requiring any special supply device, appropriate lubrication is performed, and smooth operation of devices can be ensured.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. A transmission of an outboard motor in which a crank shaft extending in a vertical direction of an engine mounted on an upper side is coupled to a drive shaft, a gear transmission capable of switching between at least two different speeds, the gear transmission being interposed between a drive shaft input shaft coupled to the crank shaft and a drive shaft output shaft driving a propeller, which are separated into an upper part and a lower part of the drive shaft, wherein:

the transmission is housed in a transmission chamber formed in a drive shaft housing and comprises the drive shaft, a counter shaft disposed in parallel with the drive shaft, a gear train bridged between each of the drive shaft input shaft and output shaft and the counter shaft, and a dog clutch mechanism selectively switching between the at least two different speeds; and the transmission comprises, in a lower part of a lower bearing of the counter shaft in a bottom part of the transmission chamber, a lower reserve part of lubrication oil reserving lubrication oil flowed down via this lower bearing, and a lubrication oil pump sending lubrication oil to respective parts of the transmission from this lower reserve part of lubrication oil.

2. The transmission of the outboard motor according to claim 1, wherein the lubrication oil pump is constituted of a spiral pump formed by making a spiral trench in a hollow inside of the counter shaft.

3. The transmission of the outboard motor according to claim 2, wherein the spiral trench of the spiral pump is formed as a spiral passage with the hollow inside of the counter shaft by inserting a separate cylinder penetrating vertically in the hollow inside of the counter shaft, and forming a spiral recessed trench in an outer periphery of this cylinder.

4. The transmission of the outboard motor according to claim 2, wherein an upper reserve part of lubrication oil is provided in an upper part of the counter shaft, the lubrication oil pump pumps up lubrication oil to the upper reserve part of lubrication oil via the hollow inside of the counter shaft, and a lubrication oil passage is provided which supplies lubrication oil to an upper bearing of the counter shaft and a bearing of the drive shaft input shaft from this upper reserve part of lubrication oil.

5. The transmission of the outboard motor according to claim 3, wherein an upper reserve part of lubrication oil is provided in an upper part of the counter shaft, the lubrication oil pump pumps up lubrication oil to the upper reserve part of lubrication oil via the hollow inside of the counter shaft, and a lubrication oil passage is provided which supplies lubrication oil to an upper bearing of the counter shaft and a bearing of the drive shaft input shaft from this upper reserve part of lubrication oil.

* * * * *